United States Patent [19]

Junkers et al.

[11] Patent Number: 4,910,096

[45] Date of Patent: Mar. 20, 1990

[54] COLD-ROLLED STEEL STRIP WITH ELECTRODEPOSITED NICKEL COATING EXHIBITING A GREAT DIFFUSION DEPTH

[75] Inventors: Dieter Junkers, Kleve; Ferdinand Schmidt, D'dorf; Nikolaus Ferenczy, Haan, all of Fed. Rep. of Germany

[73] Assignee: Hille & Müller, Düsseldorf, Fed. Rep. of Germany

[21] Appl. No.: 193,366

[22] Filed: May 12, 1988

[30] Foreign Application Priority Data

Aug. 10, 1987 [DE] Fed. Rep. of Germany ..... 3726518

[51] Int. Cl.[4] ..... B32B 15/18

[52] U.S. Cl. ..... 428/610; 428/679; 428/941

[58] Field of Search ..... 428/679, 668, 680, 684, 428/935, 941, 610

[56] References Cited

U.S. PATENT DOCUMENTS

| | | | |
|---|---|---|---|
| Re. 31,221 | 4/1983 | Elias | 428/684 |
| 2,731,403 | 1/1956 | Rubin | 428/679 |
| 3,245,885 | 4/1966 | Asano et al. | 428/679 |
| 3,773,629 | 11/1973 | Sieckmann et al. | 204/48 |
| 3,880,727 | 4/1975 | Jürging et al. | 204/48 |
| 3,917,464 | 11/1975 | Pearlstein et al. | 428/679 |
| 4,013,488 | 3/1977 | Ramquist et al. | 428/679 |

FOREIGN PATENT DOCUMENTS

| | | | |
|---|---|---|---|
| 1421999 | 7/1969 | Fed. Rep. of Germany . | |
| 2048209 | 4/1971 | Fed. Rep. of Germany . | |
| 2060120 | 6/1971 | Fed. Rep. of Germany . | |
| 2134457 | 1/1972 | Fed. Rep. of Germany . | |
| 2417952 | 10/1974 | Fed. Rep. of Germany . | |
| 2642666 | 3/1977 | Fed. Rep. of Germany . | |
| 2522130 | 6/1977 | Fed. Rep. of Germany . | |
| 2718285 | 12/1977 | Fed. Rep. of Germany . | |
| 3112919A1 | 10/1982 | Fed. Rep. of Germany . | |
| 184687 | 9/1985 | Japan | 428/679 |
| 297473 | 12/1987 | Japan | 428/668 |

*Primary Examiner*—John J. Zimmerman

*Attorney, Agent, or Firm*—Robert W. Becker & Associates

[57] ABSTRACT

A cold-rolled steel strip having an electrodeposited nickel coating exhibiting a great diffusion depth, and a process for producing this strip. In order to develop a cold-rolled strip that can be produced economically, and which has a reduced tendency to stick, good deformability, deep coating diffusion, advantageous corrosion behavior, and improved electrochemical behavior, and in order to develop a process for producing this strip, the thickness of the nickel coating should carry a coating of cobalt which has been electrodeposited to a thickness of 0.01 to 1.0 μm, and after having been coated, the cold-rolled strip should be subjected to a final heat treatment at a temperature of between 580° and 710° C.

5 Claims, No Drawings

COLD-ROLLED STEEL STRIP WITH ELECTRODEPOSITED NICKEL COATING EXHIBITING A GREAT DIFFUSION DEPTH

BACKGROUND OF THE INVENTION

The present invention relates to a cold-rolled steel strip with an electrodeposited nickel coating.

Cold-rolled strips of this type are employed in extremely diverse fields of application, where modern production techniques impose exacting requirements on the material with regard to its mechanical properties, surface finish, workability, and the like, and these requirements can be satisfied only by cold-rolled products. After cold deformation by means of appropriately prepared rollers, a cold-rolled steel strip conforming to DIN 1624 has surfaces that are smooth, dense, and bright, or that exhibit a uniform, slight roughening. In the RP and RPG surface-finish qualities, this cold-rolled strip is both pore-free and crack-free (with RPG quality also denoting a high gloss finish), so that the strip can be subjected to surface treatments with a view to increasing its corrosion resistance, in particular nickel-plating, without encountering any problems. Deep-drawable cold-rolled steel strips having an electrodeposited nickel coating are accordingly known.

In the electroplating of strip material, economic factors dictate that the coatings should in principle be thinner than those which are usually applied when electroplating individual articles. By adopting suitable measures, such as anode-screening arrangements, flooding, and the insertion of perforated plates in front of the anodes, it is possible to achieve conditions such that coatings of uniform thickness are deposited, with only minimal variations. However, the comparatively thin coatings suffer from the disadvantage of being less corrosion resistant than thicker electroplating. Furthermore, it is a drawback that a cold-rolled steel strip, whether electroplated or not, has a tendency to "stick" when it is annealed as a tightly-wound coil. Such "sticker spots" occur chiefly when cold-rolling a low-carbon strip having a surface that exhibits very slight micro-roughness. After coiling and heat treatment, "sticker spots" form, either sporadically or over large, connected areas, and at these spots the superimposed surfaces tenaciously stick to one another, and are difficult to separate. On being unwound from the pay-off reel, the "sticker spots" are separated by being torn apart, thus damaging or destroying the high-quality finish. Furthermore, "sticker spots" can cause serious interruptions in the operation of the production line, as well as give rise to material that has to be scrapped.

In the context of the production of coldrolled steel strips, it is known, moreover, that nickel-plated strips may be subjected to a heat treatment prior to further processing, with the purpose of this treatment being to increase the deformability of the composite system represented by the strip plus the coating. During this heat treatment, the electrodeposited nickel diffuses into the base metal. The diffusion rate is relatively low, which is disadvantageous, and the process is time-consuming and expensive if the aim is to achieve certain diffusion depths and to form solid solutions or mixed crystals of defined compositions.

It is therefore an object of the present invention to develop an electroplated cold-rolled steel strip which can be produced economically, and which exhibits no tendency to stick, has good deformability, has a deep coating diffusion, has advantageous corrosion behavior, and has improved electrochemical behavior, the development of this strip being designed to avoid the aforementioned drawbacks. It is a further object of this invention to provide a process for producing such a cold-rolled strip.

These and other objects and advantages of the present invention will appear more clearly from the following specification and the examples contained therein.

SUMMARY OF THE INVENTION

According to the invention, this object is achieved by providing a cold-rolled strip where the thickness of the nickel coating is 1 to 6 μm, where this nickel coating carries a coating of cobalt which has been electrodeposited to a thickness of 0.01 to 1.0 μm, and where after having been coated, the cold-rolled strip is subjected to a final heat treatment at a temperature of between 580 and 710° C.

Surprisingly, a cold-rolled strip which has been coated and heat-treated in this way no longer has a tendency to stick, and its corrosion behavior is substantially more advantageous than that of strips which have simply been nickel-plated to the same overall coating thickness. In terms of activity polarizability and electrode potential, the electrochemical behavior of the inventive coldrolled steel strips is described by values that are substantially more advantageous than those exhibited by strips which have been plated with nickel alone. The nickel coating, the cobalt coating, and the heat treatment complement one another synergistically, so as to achieve a total effect that surpasses the sum of their individual effects, the reason being that a composite material is created that can be produced economically and at the same time has properties that are very valuable in qualitative terms. A substantially higher diffusion rate occurs during the heat treatment, as a result of which a qualitative improvement in the deformability of the composite system is obtained in a more economical manner, and the coating metals diffuse into the base material to a depth that is several times greater than the coating thickness (including the nickel layer). Overall, a major technical and economic success is achieved, despite the extraordinary thinness of the cobalt coating.

The deposition of cobalt for various purposes and by means of various processes is described in the patent literature, but this literature contains no teaching of the type described by the present invention, nor does it specify the same object or means whereby this object might be achieved.

German Offenlegungsschrift 1 421 999 describes the application of cobalt coatings to plastic-base magnetic tapes.

German Offenlegungsschrift 2 048 209 claims protection for the production of bright cobalt coatings with the aid of organic additives, chiefly at lower-range current densities ($<0.5$ A/dm$^2$).

German Offenlegungsschrift 2 060 120 describes cobalt deposition from electrolytes containing iodides.

German Offenlegungsschrift 2 134 457 mentions four additives which enable cobalt to be deposited even if zinc is present as an impurity.

German Offenlegungsschrift 2 417 952 describes the deposition of cobalt (principally Co alloys) with the aid of the addition of mannitol and/or sorbitol, etc.

German Patent 2 522 130 relates to the deposition of silky-matt Ni-Co alloys with the aid of polysiloxane-polyoxyalkene block polymers.

German Offenlegungsschrift 2 642 666 describes the deposition of mirror-bright cobalt and Ni-Co alloys, with the object of economizing on nickel.

German Offenlegungsschrift 2 718 285 is concerned with an object similar to that of German Offenlegungsschrift 2 642 666.

German Offenlegungsschrift 3 112 919 describes the use of cobalt and cobalt alloy coatings for improving the adhesion of aluminum that is subsequently deposited onto them.

In an expedient embodiment of the present invention, the base material is a low-carbon steel strip, and carries a nickel coating which has a thickness of 1.5 to 5 μm, and a cobalt coating which has a thickness of 0.1 to 0.5 μm, with this coated strip being subjected to a final heat treatment that is carried out at a temperature of between 600° and 710° C., the choice of temperature depending on the grade of steel. The nickel coating is preferably deposited to a thickness of 2 μm, and the cobalt to a thickness of 0.1 μm.

It is expedient if the cold-rolled base-strip material is characterized by a ferritic structure with included cementite and a mean grain size within the range of 12.0 to 17.0 μm, with the steel containing 0.001 to 0.070% C, 0.170 to 0.350% Mn, 0.005 to 0.20% P, 0.005 to 0.020% S, 0.030 to 0.060% Al, 0.0015 to 0.0070% N, 0.003 to 0.006% B and optionally 0.005 to 0.15% Ti, either as a further addition or in place of the boron, the balance being iron and the usual impurities or trace elements (all data is quoted in % by weight). The base metal preferably has the following analysis, which is that of a steel:

| | |
|---|---|
| C | 0.030–0.060% |
| Mn | 0.200–0.250% |
| P | 0.005–0.020% |
| S | 0.005–0.015% |
| Al | 0.030–0.060% |
| N | 0.0015–0.0070% |
| Ti | 0.005–0.015% |

the balance being iron, with the usual trace elements or impurities.

Because the grain diameter is very small, smooth surfaces are obtained after deep-drawing. The steel composition is particularly important in order to obtain both the globular or equiaxed grain structure and the grain size already specified, and to achieve these characteristics over the entire length of the coil of the cold-rolled strip, including even its head and tail portions.

The process for producing the cold-rolled strip that has been described in the preceding paragraphs is, according to the invention, characterized in that: a hot-rolled strip having a thickness of 1.8 B to 2.8 B mm is employed as the starting material, this hot-rolled strip then being cold-rolled, with or without intermediate annealing, according to a schedule such that its thickness is reduced in steps, which are graded so as to achieve a relative distortion-wedge height of not more than 3% after cold-rolling, to a final thickness of between 0.10 and 0.70 mm; in that the cold-rolled strip is then electrolytically degreased in an alkaline degreasing bath, at a temperature of 50 to 70° C. and a current density of 5 to 60 A/dm$^2$, with or without polarity reversal, the duration of this degreasing treatment being 5 to 30 seconds; in that, after rinsing, the coldrolled strip is pickled for 3 to 8 second in 20 to 50% by weight sulfuric acid prior to being nickel-plated at a temperature of 50 to 80° C., a current density of 5 to 70 A/dm$^2$, and a pH of S.5 to 3.8: and in that, after rinsing, a cobalt coating is electrodeposited onto the nickel at a temperature of 50 to 70° C., a current density of 5 to 30 A/dm$^2$, and a pH of 3.0 to 3.5, after which the strip is rinsed and dried prior to a final annealing treatment which is carried out in a protective atmosphere at a temperature of between 580 and 710° C.

This process results in the production of a cold-rolled strip which has no tendency to stick, is characterized by a current flow of a substantially higher order of magnitude than has been known, as can be observed by chronoamperometric measurements, and which is exceptionally economical by virtue of the fact that the expensive cobalt is applied as a thin coating. During the heat treatment, diffusion causes the nickel and cobalt to penetrate deeply into the base material.

The following electrolyte compositions have advantages that render them suitable for eleotrodepositing nickel and cobalt:

| Nickel deposition | Electrolyte composition |
|---|---|
| $NiSo_4.6H_2O$ | 150–300 g/l |
| Cl (as $NiCl_2.6H_2O$) | 15–30 g/l |
| boric acid | 40–42 g/l |

| Cobalt deposition | Electrolyte composition |
|---|---|
| $CoSO_4.7H_2O$ | 300–350 g/l |
| $CoCl_2.6H_2O$ | 40–60 g/l |
| NaCl | 15–25 g/l |
| boric acid | 40–42 g/l |

Further details, features and advantages of the subject matter of the invention can be inferred from the following description of four Examples.

1.1 Base material (steel analysis)

| Composition A | | Composition C | |
|---|---|---|---|
| C | 0.020–0.070% by wt. | C | 0.020% by wt. |
| Mn | 0.170–0.350% by wt. | Mn | 0.170% by wt. |
| P | 0.005–0.020% by wt. | P | 0.005% by wt. |
| S | 0.005–0.020% by wt. | S | 0.005% by wt. |
| Al | 0.030–0.060% by wt. | Al | 0.030% by wt. |
| B | 0.003–0.006% by wt. | N | <0.003% by wt. |
| N | <0.0070% by wt. | | |

| Composition B | | Composition D | |
|---|---|---|---|
| C | 0.030–0.060% by wt. | C | 0.001–0.010% by wt. |
| Mn | 0.200–0.250% by wt. | Mn | 0.150–0.200% by wt. |
| P | 0.005–0.020% by wt. | P | 0.005–0.020% by wt. |
| S | 0.005–0.015% by wt. | S | 0.005–0.15% by wt. |
| Al | 0.030–0.060% by wt. | Al | 0.030–0.060% by wt. |
| Ti | 0.005–0.015% by wt. | Ti | 0.05–0.15% by wt. |
| N | <0.0070% by wt. | N | <0.007% by wt. |

Microstructure: ferrite with included cemetite. The grain size (expressed as mean grain size) is 12.0 to 17.0 μm, the grains being of equiaxed form, so as to obtain smooth surfaces after deep-drawing, by virtue of the very small grain diameter.

The composition of the steel is decisively important with regard to obtaining equiaxed grains, of the size specified above, over the entire length of the coil, including even its head and tail portions.

1.2 Cold-rolling

In the production of the anticorrosion-coated steel strips according to the present invention, a hot-rolled strip having a thickness of 1.8 to 2.8 mm is employed as the starting material. The hot-rolled strip is then cold-rolled, with or without intermediate annealing, according to a schedule such that its thickness is reduced in steps which are graded so as to achieve a relative distortion-wedge height of not more than 3%. The final thickness, after cold-rolling, is 0.10 to 0.70 mm.

1.3 Electroplating 1.3.1 Electrolytic degreasing is to be performed in a commercially-available alkaline degreasing bath, at a temperature of approximately 50 to 70° C. and at a current density of 5 to 60 A/dm$^2$, with or without polarity reversal, the duration of this degreasing treatment to be 5 to 30 seconds.

1.3.2 Rinse 1.3.3 Pickling is to be performed in 5 to 20% by weight sulfuric acid, for 3 to 8 seconds.

1.3.4 Nickel-plating is to be performed at a temperature of 50 to 80° C, a current density of 5 to 70 A/dm$^2$, and a pH of 3.5 to 3.8.

| Electrolyte composition: | |
|---|---|
| $NiSO_4.6H_2O$ | 150–300 g/l |
| Cl (as $NiCl_2.6H_2O$) | 15–30 g/l |
| boric acid | 40–42 g/l |
| coating thickness | approx. 1 μm |

1.3.5 Rinse 1.3.6 The Co coating is to be electrodeposited at a temperature of 50 to 70° C, a current density of 5 to 30 A/dmz, and a pH of 3.0 to 3.5.

| Electrolyte composition: | |
|---|---|
| $CoSO_4.7H_2O$ | 300–350 g/l |
| $CoCl_2.6H_2O$ | 40–60 g/l |
| NaCl | 15–25 g/l |
| boric acid | 40–42 g/l |
| coating thickness | 0.01 to 0.8 μm |

1.3.7 Rinse 1.3.8 Dry

1.4 Heat treatment (annealing)

The coated material is annealed using a composition-controlled protective gas (containing up to approximately 100% $H_2$), so as to obtain an unblemished, stain-free surface.

The annealing treatment is performed at a temperature of between 580 and 710° C., the choice of temperature depending on the grade of steel and the thickness of the electrodeposited coating. Precise control of the diffusion depth is achieved by optimizing the heat treatment at different temperatures.

On testing a cold-rolled steel strip that had been produced by this process, i.e. by nickel-plating, overlaying with a thin coating of Co, and a final heat treatment, it was found that the tendency to stick had been virtually eliminated. The cold-rolled strips exhibit very good corrosion resistance in alkaline media. Chronoamperometric measurements were performed in order to measure the electrochemical behavior. This measuring method is based on the fact that, at a constant potential (e.g. +100 mV), the rate at which an oxide layer forms on the surface of a test specimen increases as the activity of the surface increases. The measurements were performed by means of the so-called three-electrode system, using the following electrodes:

reference electrode: mercuric oxide/mercury (HgO/Hg)

auxiliary electrode: platinum wire working electrode: disc-shaped specimen of the steel strip which had been cold-rolled coated with nickel and cobalt, and heat treated in accordance with the invention (area 283 mm$_2$)

electrolyte: 35% strength potassium hydroxide solution

The chronoamperometric measurements are performed after pre-activation, which removes the natural oxide film from the surface immediately before the measurements are started. A negative potential of approximately 550 mV was applied in order to bring about pre-activation.

It was found, surprisingly, that whereas the working electrodes which had simply been nickel-plated showed a current flow of approximately 8 to 10 μA, the current flow amounted to 80 to 90 mA in the case of the working electrodes that had been built up in accordance with the invention. As a result of the rapid formation of oxide, the current decreased very rapidly, and tended (asymptotically) to 0 mA after approximately 3 minutes. In the case of the working electrodes that had been plated with nickel alone, the current did not tend to zero until 15 to 20 minutes had elapsed.

On immersion in alkaline electrolytes, it was found that the cold-rolled steel strip produced in accordance with the invention displays an electrode potential that remains constant for at least twice as long as the potential displayed by an electrode consisting of a cold-rolled strip that has been plated with nickel alone.

Finally, metallographic sections and surface analyses, the latter performed by means of a glow-discharge lamp, yielded results which showed, in a surprising manner, that the coating metals nickel and cobalt had diffused to depths several times greater than the thickness of the coating that had been applied. In the case involving the application of a coating comprising 2 μm of nickel and 0.1 μm of cobalt, the diffusion depth was found to have reached a value of 5 μm—this being the distance to which coating metal had penetrated into the steel base material. These results demonstrate that the process according to the invention enables a new composite material to be produced, and that this new material has exceptional properties.

The present invention is, of course, in no way restricted to the specific disclosure of the specification and examples, but also encompasses any modifications within the scope of the appended claims.

What we claim is:

1. A cold-rolled steel strip comprising:

a nickel coating electrodeposited on a base strip to a thickness of from 1 to 6 μm; and a cobalt coating electrodeposited on said nickel coating to a thickness of 0.01 to 1.0 μm, with said strip, after said coatings have been deposited, being subjected to a final heat treatment at a temperature of between 580° and 710° C. to diffuse said coatings into said strip.

2. A cold-rolled strip according to claim 1, which includes a base strip in the form of a low-carbon steel strip, a 1.5 to 5 μm thick nickel coating, and a 0.1 to 0.5 thick cobalt coating, with said final heat treatment being carried out at a temperature of between 600 ° and 10° C.

3. A cold-rolled strip according to claim 2, in which said nickel coating has a thickness of 2 μm, and said cobalt coating has a thickness of 0.1 μm.

4. A cold-rolled strip according to claim 2, in which said base strip has a ferritic structure with included cementite and a mean grain size within the range of 12 to 17 μm, with said steel containing 0.001 to 0.070% by weight C, 0.170 to 0.350% by weight Mn, 0.005 to 0.020% by weight P, 0.005 to 0.020% by weight S, 0.030 to 0.060% by weight Al, 0.0015 to 0.0070% by weight N, at least one of the group consisting of 0.003 to 0.006% by weight B and 0.005 to 0.15% by weight Ti, with the remainder being iron with the usual trace elements.

5. A cold-rolled strip according to claim 4, in which said base strip has a steel analysis of 0.030 to 0.060% C, 0.200 to 0.250% Mn, 0.005 to 0.020% P, 0.005 to 0.015% S, 0.030 to 0.060% Al, 0.0015 to 0.0070 N, 0.005 to 0.015% Ti, with the remainder being iron with the usual trace elements.

* * * * *